United States Patent [19]

Hahn

[11] 4,134,003

[45] Jan. 9, 1979

[54] DISHWATER CONTROL

[75] Inventor: Ronald E. Hahn, St. Joseph, Mich.

[73] Assignee: Whirlpool Corporation, Benton Harbor, Mich.

[21] Appl. No.: 769,037

[22] Filed: Feb. 16, 1977

[51] Int. Cl.[2] ..... H05B 1/02; B08B 3/02; B08B 3/10

[52] U.S. Cl. ..... 219/327; 34/48; 134/57 D; 134/58 D; 219/334; 219/492; 307/141.8

[58] Field of Search ..... 219/327, 334, 492; 134/57 R, 57 D, 58 R, 58 D, 105-107, 56 R, 56 D; 34/48; 68/12 R, 15; 307/141.8

[56] References Cited

U.S. PATENT DOCUMENTS

| | | | |
|---|---|---|---|
| 3,049,133 | 8/1962 | Jacobs | 134/57 D |
| 3,635,229 | 1/1972 | Jacobs | 134/107 |
| 3,890,987 | 6/1975 | Marcussen et al. | 134/57 D |

*Primary Examiner*—A. Bartis

*Attorney, Agent, or Firm*—Wegner, Stellman, McCord, Wiles & Wood

[57] ABSTRACT

A dishwasher utilizing treating liquid for washing dishes in a treating cycle and air for drying the washed dishes in a drying cycle. An electric heater is provided for heating the dish-treating liquid and the drying air. A control is provided for energizing the heater to heat the treating liquid as an incident of the dishwasher operating in the treating cycle and selectively causing energization of the heater as an incident of the dishwasher operating in the drying cycle. The control further includes structure for preventing energizing of the heater notwithstanding the dishwasher operating in the drying cycle.

6 Claims, 2 Drawing Figures

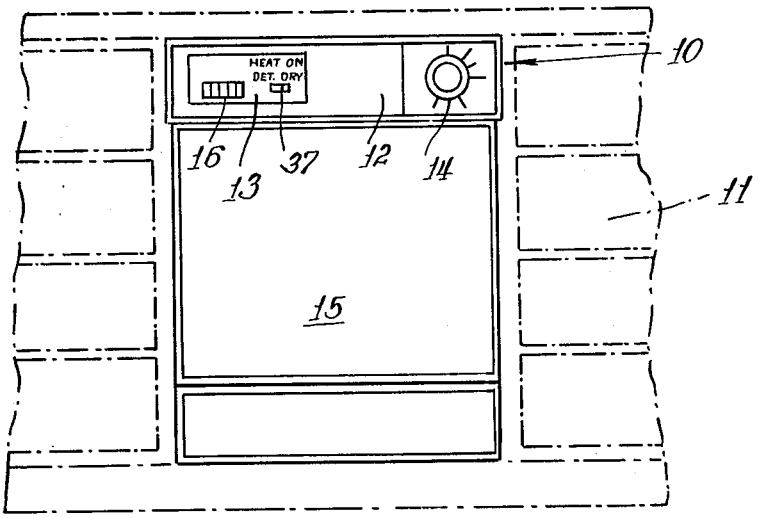
Fig. 1
Fig. 2
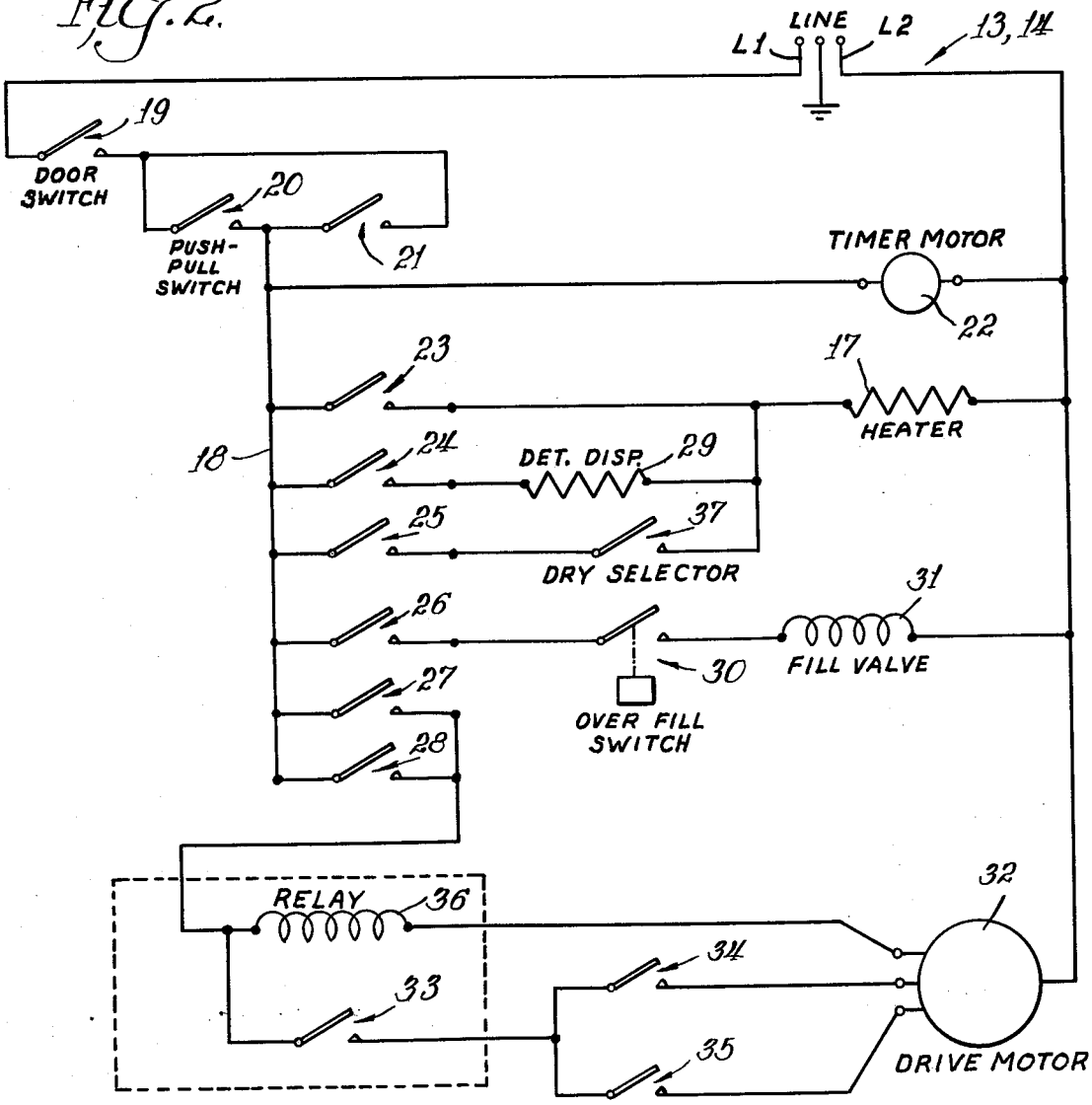

DISHWATER CONTROL

BACKGROUND OF THE INVENTION

1. Field of the Invention

This invention relates to dishwashers and in particular to control means for use in controlling the operation of dish-washers.

2. Description of the Prior Art

In the conventional dishwasher, means are provided for washing dishes therein during a treating cycle with a suitable treating liquid. An electric heater may be provided for heating the treating liquid for improved efficiency in the washing of the dishes.

It is further conventional to utilize such electric heaters to heat the air in the dishwasher during the drying cycle to provide facilitated drying of the washed dishes.

One improved dishwasher control is illustrated in U.S. Pat. No. 3,539,153 of Allen L. Wennerberg et al, which patent is owned by the assignee hereof. The control therein includes a switch which is selectively operable to fire an SCR so as to conduct through a pair of resistors. The effect thereof is to de-energize the heater relay for shutting off the heating unit. The control of the heater in this manner is initiated at the beginning of the drain portion of the final rinse cycle. Alternatively, the control may be arranged to prevent the heating unit from ever being turned on such as for use in washing delicate items.

James W. Jacobs, in U.S. Pat. No. 3,635,229, shows a selective heating system for an automatic washing machine having manually operated selector switches connected in electrical series with a dishwasher timer control circuit for determining which of the heaters will be operative during the washing and drying cycles. The control is arranged so as to permit operation of the apparatus for a full cycle without energizing either of the selectively controlled heaters.

In U.S. Pat. No. 3,798,465 of Lauren W. Guth, a control arrangement for a washing machine is shown having a selector which selectively opens the circuit to the heating element during the dry cycle as desired by the user. The dry cycle selector device includes a switch linked by a shaft driven by a control knob so as to make contact with preselected contact points to connect the heater selectively to two different timer control switches for providing different lengths of time in the drying operation. The heater is energized only through the selector switch.

SUMMARY OF THE INVENTION

The present invention comprehends an improved dishwasher control arranged to energize the heater means to heat the treating liquid as an incident of the dishwasher operating in a treating cycle and selectively causing energization of the heater as an incident of the dishwasher operating in the drying cycle of preventing energization of the heater notwithstanding the dishwasher operating in the drying cycle. The control means more specifically includes a first switch for connecting the heater means to a power supply as an incident of the dishwasher operating in the treating cycle, a second switch in parallel with the first switch for connecting the heater means to the power supply as an incident of the dishwasher operating in the drying cycle, and a manually operable control including a third switch for selectively preventing connection of the heater means to the power supply by the second switch.

The third switch may comprise a single-pole, single throw switch connected in series with the second switch with the series connection of the second and third switches being connected in parallel with the first switch.

The parallel connection of the three switches may be connected in series with the heater.

The selectively operable switch may comprise a toggle switch and may be arranged to permit selective control of the energizing of the heater means at any time during the drying cycle while having no effect on the heater means during the treating cycle.

The control of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a front elevation of a dishwasher having a control means embodying the invention; and FIG. 2 is a schematic wiring diagram of the control.

DESCRIPTION OF THE PREFERRED EMBODIMENT

In the exemplary embodiment of the invention as disclosed in the drawing, a dishwasher generally designated 10 is illustratively shown as comprising a built-in dishwasher installed in a kitchen counter 11, it being understood that the dishwasher may comprise any suitable form of dishwasher. As shown in FIG. 1, the dishwasher may include a front panel 12 having suitable controls 13 and 14 carried thereon. The dishwasher may further include a door 15 for providing selective access to the interior thereof.

In the illustrated embodiment, control 13 is provided with a plurality of pushbuttons 16 for providing automatic operation cycles which illustratively may include "Super-Scour," "Super Wash," "Rinse-Hold," and "Short" cycles. The "Super-Scour" cycle may provide automatic water temperature control for scouring away stubborn, baked-on foods and the like during the washing cycle. The "Super Wash" cycle provides several vigorous washes followed by suitable rinses. The "Rinse-Hold" cycle provides a quick rinse where desired to defer the washing operation.

The apparatus further includes an electric heater 17 for heating the liquid in the dishwasher tub and for selectively heating the air during the drying cycle.

Thus, referring more specifically to the schematic wiring diagram of FIG. 2, power is supplied to the control means from power supply means L1 and L2. Power supply lead L1 is connected to a control lead 18 through a single-pole, single throw door switch 19, and a single-pole, single throw push-pull switch 20. A timer-operated switch 21 is connected in parallel with switch 20.

The control includes an automatic timer having a motor 22 connected between lead 18 and power supply lead L2. Thus, when the door 15 is closed to close switch 19 and the push-pull switch 20 is closed, the timer motor is energized to initiate automatic operation of the dishwasher under the control of the timer. Shortly before the end of the cycle, timer switch 21 closes, after which push-pull switch 20 opens. This maintains operation of the apparatus and provides for automatic termination of the cycle by reopening switch 21 at the end of the cycle.

The timer further includes six timed switches 23, 24, 25, 26, 27, and 28. Each of the switches comprises a single-pole switch connected to lead 18. Switch 23 is connected in series with heater 17 between lead 18 and power supply lead L2.

Switch 24 is connected in series with a bimetal actuated detergent dispenser heater element 29 in series with heater 17.

Switch 26 is connected in series with an overfill switch 30, in turn connected in series with a fill valve solenoid 31.

Switches 27 and 28 are connected to a pump motor 32 through control switches 33, 34, 35 with a motor starting relay coil 36 being connected in parallel with the switches.

The present invention comprehends the provision of improved means for controlling the energization of heater 17 whereby the heater is controlled selectively by timer switches 23 and 25 and further selectively by a dry heat option switch 37 connected in series with the switch 25 and heater 17. The series connection of switch 25 and switch 37 is connected in parallel with switch 23, as shown in FIG. 2.

Thus, timer switch 23 controls the energization of heater 17 to heat the treating liquid as an incident of the dishwasher operating in the treating cycle portion of its operation. Control of heater 17 by switch 23 is independent of the single-pole, single throw switch 37 which, as indicated above, controls only the circuit to the heater from timer switch 25.

The switch 37 may comprise a manually operable toggle switch which, as shown in FIG. 1, may be provided in control 13 adjacent pushbuttons 16. Switch 23 is open throughout the period while the dishwasher is operating in the drying cycle. Switch 25 is closed during the dry portion of the cycle. In the heat dry position, switch 37 is closed to place heater 17 in series with switch 25 whereby the heater is energized as an incident of the dishwasher operating in the drying cycle. Alternatively, when the switch 37 is depressed to provide an air dry function, the switch is open to disconnect the switch 25 from heater 17 thereby preventing heating of the air during the drying cycle and allowing the dishes to be air dried.

The use of the dry selector switch provides a substantial reduction in the electrical energy usage by the dishwasher. Illustratively, it has been determined that the use of the dry selector switch to eliminate the heating of the air during the drying cycle may effect an energy saving of up to approximately 37% in the "Super Wash" mode of operation, up to 23% in the typical "Super-Scour" operation, and up to 43% in the "Short" cycle operation.

Illustratively, a savings of approximately 0.25 KWH may be effected each time the air dry mode of drying is utilized.

The operation of the dry selector switch 37 may be effected at any time. Illustratively, the switch may be allowed to remain in either of its alternative positions so as to permit a desired repeated operation of the dishwasher in the selected mode. Further alternatively, the switch may be manipulated at any time, including during a drying cycle, so as to change the mode of operation as desired by the user.

The dry selector functioning of the improved control is extremely simple and economical of construction while yet providing the highly desirable features discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a dishwasher having operating means utilizing treating liquid for washing dishes in a treating cycle and air for drying dishes in a drying cycle, and electric heater means arranged to heat the dish-treating liquid and to heat the dish drying air, an improved control means for energizing said heater means to heat the treating liquid as an incident of the dishwasher operating in said treating cycle, and selectively (a) causing energizing of said heater means as an incident of the dishwasher operating in said drying cycle, or (b) preventing energizing of said heater means notwithstanding the dishwasher operating in said drying cycle, said control means comprising:

a first switch for connecting said heater means to a power supply as an incident of the dishwasher operating in said treating cycle;

a second switch in parallel with said first switch for connecting said heater means to the power supply as an incident of the dishwasher operating in said drying cycle; and a manually operable control for selectively preventing connecting of the heater means to said power supply by only said second switch.

2. The dishwasher structure of claim 1 wherein said manually operable control comprises a single-pole, single throw switch connected in series with said second switch.

3. The dishwasher structure of claim 1 wherein said manually operable control means comprises a third switch connected in series with said second switch, the series connection thereof being connected in parallel with said first switch.

4. The dishwasher structure of claim 3 wherein said third switch comprises a toggle switch.

5. The dishwasher structure of claim 3 wherein said third switch is arranged to permit said selective control of the energizing of the heater means at any time during the drying cycle.

6. The dishwasher structure of claim 1 wherein said manually operable control means comprises a third switch connected in series with said second switch, the series connection thereof being connected in parallel with said first switch, the parallel connection of said switches being connected in series with said heater means.

* * * * *

UNITED STATES PATENT AND TRADEMARK OFFICE

CERTIFICATE OF CORRECTION

PATENT NO. : 4,134,003

DATED : January 9, 1979

INVENTOR(S) : Ronald E. Hahn

It is certified that error appears in the above-identified patent and that said Letters Patent are hereby corrected as shown below:

Correct the title to read --DISHWASHER CONTROL-- rather than "Dishwater Control" as now shown.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*